United States Patent [19]

Ward

[11] 4,072,604

[45] Feb. 7, 1978

[54] PROCESS TO SEPARATE HYDROCARBONS FROM GAS STREAMS

[75] Inventor: Dennis J. Ward, South Barrington, Ill.

[73] Assignee: UOP Inc., Des Plaines, Ill.

[21] Appl. No.: 706,859

[22] Filed: July 19, 1976

Related U.S. Application Data

[63] Continuation-in-part of Ser. No. 560,854, March 21, 1975, abandoned, which is a continuation-in-part of Ser. No. 453,656, March 21, 1974, abandoned.

[51] Int. Cl.[2] ..... C10G 5/04

[52] U.S. Cl. ..... 208/341; 55/46; 55/223; 208/101

[58] Field of Search ..... 208/101, 341; 55/46, 55/48, 51, 223

[56] References Cited

U.S. PATENT DOCUMENTS

| | | | |
|---|---|---|---|
| 2,181,302 | 11/1939 | Keith et al. | 208/101 |
| 2,371,817 | 3/1945 | Frey | 260/681.5 R |
| 3,347,621 | 10/1967 | Papadopoulos et al. | 208/341 |
| 3,574,089 | 4/1971 | Forbes | 208/101 |

*Primary Examiner*—Herbert Levin

*Attorney, Agent, or Firm*—James R. Hoatson, Jr.; Robert W. Erickson; William H. Page, II

[57] ABSTRACT

A process for the separation of specific $C_2$ to $C_6$ hydrocarbons from a gaseous feed stream containing $C_1$ to $C_6$-plus hydrocarbons. The feed stream enters an absorber and is first contacted by a primary lean liquid which is a portion of the bottoms product of the stripping column to which the rich absorber liquid is charged. The primary lean liquid contains the specific hydrocarbons which it is desired to separate from the feed stream. The feed stream is then contacted by a secondary lean liquid which does not contain these hydrocarbons and which is produced by fractionating a second portion of the stripper bottoms.

5 Claims, 1 Drawing Figure

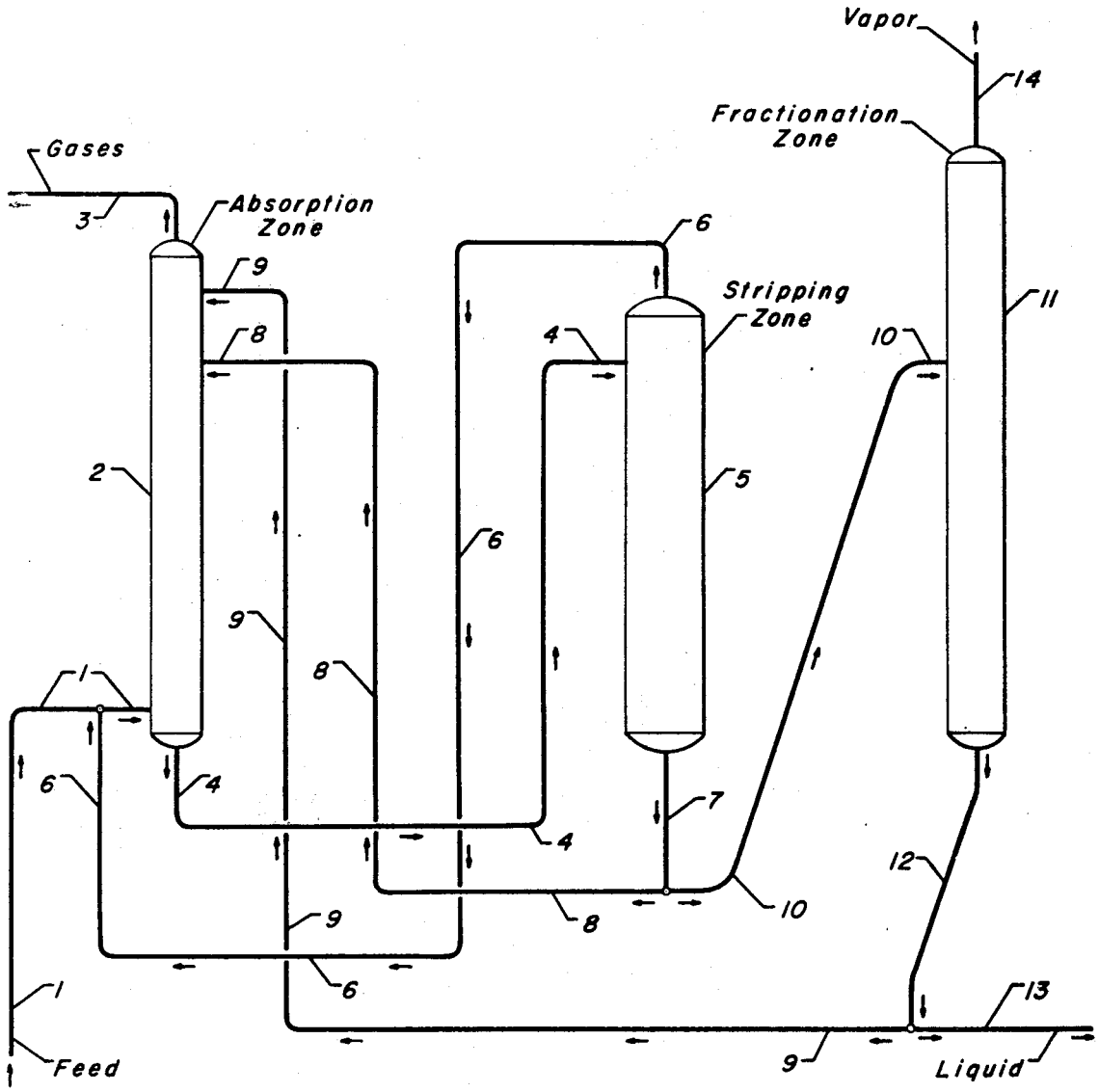
Vapor
14
Fractionation Zone
Gases
3
Absorption Zone
9
8
6
Stripping Zone
4
10
11
2
5
6
9
8
1
6
4
7
4
12
10
8
9
6
1
13
Feed
9
Liquid

PROCESS TO SEPARATE HYDROCARBONS FROM GAS STREAMS

CROSS-REFERENCE TO RELATED APPLICATIONS

This application is a continuation-in-part of my copending application Ser. No. 560,854, filed Mar. 21, 1975, now abandoned which was a continuation-in-part of my now abandoned application Ser. No. 453,656, filed Mar. 21, 1974.

FIELD OF THE INVENTION

The field of art to which this invention pertains is the separation of hydrocarbons. It particularly relates to the separation and recovery of specific vaporous organic and inorganic constituents from a gaseous feed stream. Specifically, this invention relates to the separation and recovery of selected $C_2$ to $C_6$ hydrocarbons from a gaseous feed stream comprising $C_1$-$C_6$-plus hydrocarbons as performed in a gas concentration unit such as found in petroleum refineries.

PRIOR ART

Substances which are vaporous at normal conditions are employed in the synthesis of many organic and inorganic compounds. Ethylene, for example, is in demand as a starting material in the synthesis of alcohols and synthetic rubber. Propylene and butylenes are in particularly great demand for plastics manufacture and for conversion to high octane motor fuel blending components by polymerization and alkylation processes. Sources of these vaporous materials include petroleum and chemical cracking and conversion processes such as thermal cracking, catalytic cracking, reforming, hydrocracking, fermentation, etc. The chemical reactions occurring in these processes produce commercially desirable quantities of vaporous materials, often as side products mixed with the main products of these processes. The value of these vaporous materials makes it desirable to recover them and concentrate them as much as is economically possible. For this reason, gas separation processes are commonly used in conjunction with these conversion processes to recover and concentrate these valuable vapors.

There are several types of commercial gas separation and purification processes. For instance, beds of regenerable adsorbents may be used for such purposes. Another type of process is typified by ethylene manufacturing units and consists of high pressure, low temperature fractionation operations. A third type of process, which is widely used in oil refineries, consists of a combined absorber-stripper operation and is commonly referred to as a gas concentration unit.

Gas concentration units currently in use are comprised of three major sections or zones: absorption, stripping and fractionation. In essence, there zones serve, respectively, to absorb all but the lightest gaseous components from a feed gas stream, to strip the undesired lower boiling point dissolved gases from the rich absorber liquid, and to fractionate the absorbed components into various product streams, as by rejecting heavier hydrocarbons.

U.S. Pat. No. 2,181,302 illustrates a process which is similar to that claimed herein to the extent that the feed gas stream passing upward through an absorption zone is first contacted by a primary lean liquid and then by a secondary lean liquid. This reference however is directed toward the production of gasoline by the reaction of $C_3$ and $C_4$ hydrocarbons, and it does not teach performing the absorption in a manner which uses the inventive concept. This reference uses as a primary lean liquid a mixture of gasoline, gas oil and a small portion of heavier oils. The secondary lean liquid is taught to be a heavier oil, such as a gas oil and may include heavier oils. Neither of these absorber liquids is taught to contain any $C_3$-$C_4$ hydrocarbons which it is desired to recover. In comparison, the primary lean liquid used for the recovery of $C_3$-$C_4$ hydrocarbons in the preferred embodiment as claimed herein contains $C_3$-$C_4$ hydrocarbons. That is, in the subject process the primary lean absorber liquid contains the same material which it is desired to recover from the rising feed gas stream.

A second distinguishing feature is that in the reference the combined absorption media is removed from the absorber tower and passed into an intermediate point of a full fractionation column having both rectification and stripping sections. In the subject process the combined absorption media is passed into the top of a stripping column. The reference fractionation column is operated so to produce a bottoms stream lacking the components to be recovered, in this case $C_3$-$C_4$ hydrocarbons. The subject stripping column however is operated in a manner which produces a bottoms stream containing all of the components to be recovered, again in this example, $C_3$-$C_4$ hydrocarbons.

The overhead streams produced in each of these columns is also treated differently. In the subject process, the overhead stream of the stripping column is preferably admixed with the feed stream to the process and then passed directly into the bottom of the absorber. In the reference, the overhead material of the fractionator is passed into a separating zone which is not part of the absorber in admixture with the feed stream to the process, and only after rising through this trayed separating zone does any portion of the feed stream or overhead material enter the absorption zones. It is also taught in the reference that the absorption media is prevented from entering the separating zone by trap out trays located above the separating zone. The admixture of the overhead material and the feed stream therefore does not contact the combined absorption media as claimed herein.

BRIEF SUMMARY OF THE INVENTION

The present invention provides a process for the recovery of normally vaporous or normally liquid components from a composite stream containing these components, such as an effluent stream from a chemical conversion zone. This process has the advantage of requiring less energy to operate the fractionation column in which the desired product is finally separated from the absorber liquid.

Two lean absorber liquids absorb normally vaporous components from a gaseous feed composite stream in an absorption zone. The resulting rich absorber liquid passes to a stripping zone wherein light gases dissolved in the rich absorber liquid are removed and a stripped liquid is produced. This stripped liquid contains both a heavy absorption media and those hydrocarbons which it is desired to recover from the feed stream. A first aliquot portion of the stripped liquid enters a central portion of the absorption zone as a primary lean absorber liquid, and the remaining portion of the stripped liquid passes to a fractionation zone. The fractionation zone provides a vapor overhead product comprising the hydrocarbons to be recovered and a liquid bottoms product. At least a portion of this liquid bottoms product passes into an upper portion of the absorption zone as a secondary lean absorber liquid.

DESCRIPTION OF THE DRAWING

The preferred embodiment of the present invention is illustrated in the attached drawing and comprises the recovery of $C_3$ and $C_4$ hydrocarbons from a gaseous feed stream. Only such details are included as are necessary for a clear understanding of my invention, and no intention is thereby made to unduly limit its scope. Certain items necessary to the operation of my invention but unnecessary to the understanding of it, such as certain valves, pumps, instrumentation and other equipment, have been omitted for the sake of simplicity.

Referring now to the drawing, a gaseous feed stream comprising hydrogen, methane, ethane, various $C_3$ and $C_4$ hydrocarbons such as propylene, normal and isobutane, and possibly small amounts of heavier hydrocarbons such as pentane and hexane enters the process through conduit 1. The feed stream is admixed with the material in line 6 and passed into the bottom of an absorption zone 2. A secondary lean absorber liquid comprising a naphtha enters the top of absorption zone in conduit 9. A primary lean absorber liquid in conduit 8 enters the absorption zone below the entry point of the secondary lean absorber liquid. These lean absorber liquids pass downwardly through the absorption zone countercurrent to the rising feed stream absorbing at least a portion of the vaporous materials of the feed stream. Each component of the feed stream will be absorbed to some extent dependent upon the equilibrium conditions of the system. Those gases not absorbed by the lean absorber liquids exit the top of the absorption zone in conduit 3.

A rich absorber liquid stream, containing any liquid feed components, the absorber liquids and the absorbed gaseous feed components, exits the absorption zone in conduit 4 and passes into an upper portion of a stripping zone 5. The stripping zone is operated at conditions which cause the rejection of low boiling materials, including $C_1$ and $C_2$ hydrocarbons, which are contained in the rich absorber liquid stream. These undesired absorbed gases are thereby removed from the rich oil in the stripping zone 5 and are recycled in conduit 6 to the absorption zone 2 via conduit 1, intermixing therein with the feed. This stripper overhead vapor stream is passed into the absorption zone for the purpose of recovering any $C_3$ and $C_4$ hydrocarbons which it may contain.

A stripped liquid stream is withdrawn from the stripping zone 5 in conduit 7. This stream contains $C_3$ and $C_4$ hydrocarbons and also heavier gasoline components such as $C_7$ and $C_9$ hydrocarbons. A first aliquot portion of the stripped liquid exits conduit 7 in conduit 8 and passes to the absorption zone as the aforesaid primary lean absorber liquid. The remaining portion of stripped liquid exits conduit 7 in conduit 10 and passes to a fractionation zone 11 where this portion of the stripped liquid is separated into an overhead vapor product and a bottoms liquid product. The overhead product is withdrawn from the fractionation zone and exits the process in conduit 14. It is an essentially pure mixture of $C_3$ and $C_4$ hydrocarbons. The bottoms liquid product exits the fractionation zone in conduit 12. A portion of the liquid product exits conduit 12 in conduit 9, passing as aforesaid secondary lean absorber liquid to absorption zone 2. The remaining portion of the liquid product is withdrawn from conduit 12 in conduit 13 and exits the process. The withdrawn portion is equal in flow rate to the net rate at which $C_5$-plus hydrocarbons are introduced to the absorption zone by the feed stream.

DETAILED DESCRIPTION OF THE INVENTION

The production of refined petroleum products and the production of chemical products such as food stuffs, fertilizer and the like involve numerous processes such as distillation, catalytic reforming, catalytic cracking, fermentation, chemical conversion, etc. These processes are well known to those skilled in the art and need not be discussed in great detail herein. However, a characteristic of these processes and many others to be found in petroleum refineries and processing plants is the production of components which are broadly referred to herein as "normally vaporous materials" and "normally liquid materials." Normally vaporous materials are those which at "normal" conditions of temperature and pressure exist in the vapor state. Conditions referred to in the art as normal conditions are a pressure of 1 atmosphere and a temperature of 60° F. When normally vaporous materials are transformed from the vapor state to the liquid state, they are said to become liquefied vapors. Normally liquid materials are those which exist in the liquid state at normal conditions.

As pointed out above the components of these various streams are of value as products, as raw materials or as fuel. It is an objective of this invention to provide a process for the recovery of a higher boiling point compound from a vapor stream containing components with lower boiling points. It is another objective of this invention to provide a process for use in oil refinery gas concentration units. A further objective of the invention is to reduce the utility costs of operating gas concentration units.

The present invention broadly provides a method for recovering components from the effluent of any refining or conversion process for organic or inorganic materials which contains the types of components which are referred to as normally vaporous and normally liquid. For instance, the invention may be used in the recovery of $C_3$ and $C_4$ hydrocarbons from a gaseous stream which also comprise hydrogen, ammonia, hydrogen sulfide, methane and $C_2$ hydrocarbons. The invention may also be utilized to remove, for instance, a $C_6$ hydrocarbon, such as benzene or normal hexane, from a gaseous stream comprising hydrocarbons having anywhere from one to seven or more carbon atoms per molecule. In any of these applications the sequential absorption-stripping operations of the subject process will result in the simultaneous removal from the feed stream of higher carbon number hydrocarbons than the target hydrocarbon. Therefore, in the just mentioned recovery of $C_6$ hydrocarbons, most of the $C_7$ and higher hydrocarbons will also be removed from the feed stream. These higher boiling materials are separated from the product stream by rejection as part of the fractionation column bottoms stream in the column producing the product as an overhead stream.

A broad embodiment of the invention may be characterized as a process for the recovery of a higher boiling point component of a vapor stream containing components with lower boiling points. As this implies, the invention is also suitable for the recovery of ethane or ethylene from a stream containing methane and hydrogen or for the separation and recovery of various inorganic compounds. For instance, carbon tetrachloride or boron trifluoride can be recovered from hydrogen-containing gas streams by the subject process. Two or more embodiments of the invention may be used in series for the recovery of different compounds. For instance, the feed stream may be processed in a first absorption zone to remove $C_3$ and $C_4$ hydrocarbons and then the rejected gases may be passed into a second absorption zone to selectively recover $C_2$ hydrocarbons.

For illustrative purposes, the present invention will be described with reference to the effluent from a hydrocarbon cracking process. Normally liquid and normally vaporous hydrocarbons from the cracking unit conventionally leave in both the liquid and vapor streams from the fractionation zone of the unit. The vapor streams are sent to a separation process referred to as a gas concentration unit for recovery of a stabilized liquid hydrocarbon product, or stabilized gasoline, purified hydrocarbon vapors and light gases. The stabilized gasoline product principally comprises hydrocarbons having 5 or more carbon atoms per molecule and which have a boiling point below 400° F. This gasoline is referred to as stabilized because it does not contain light materials such as ethane, propane or hydrogen which would contribute effervescence to the gasoline. The hydrocarbon vapor stream produced in the separation process typically comprises hydrocarbons having 3 to 4 carbon atoms per molecule and includes such compounds as propane, butylenes and the like. These hydrocarbon vapor products are frequently recovered at elevated pressures and liquefied and in such a state are referred to in the art as liquefied petroleum gas, or LPG. This product may be further processed in downstream fractionation facilities if it is desired to produce further purified hydrocarbon product streams such as, for example, a stream substantially comprising hydrocarbons of only 3 carbon atoms, 4 carbon atoms, etc. The light gas stream from the separation process commonly contains compounds such as methane and hydrogen. This stream of light components, sometimes referred to as non-condensible gases, is valuable primarily as fuel and is conducted from the separation process to a fuel system.

In the preferred embodiment of the separation process, which is shown in the attached drawing, an admixture of normally liquid hydrocarbons and normally vaporous hydrocarbons and methane and hydrogen gases enters near the bottom of multistage absorption zone 2 through conduit 1. It should be noted that this is only one method of performing the preferred embodiment. Another method is to introduce the vaporous portion of the feed as shown and to introduce any liquid portion of the feed closer to the top of the absorption zone. The considerations involved here are: (a) the vaporous portion of the feed should upwardly traverse as many contact stages as possible within the absorption zone such that soluble components of the vapor are dissolved into the liquid within the absorption zone to the greatest extent possible; (b) if the liquid portion of the feed comes to the separation process substantially unsaturated in soluble vaporous components, then it should enter the absorption zone nearer the top in order to pass as many absorption stages as necessary to absorb as much as possible of these vaporous components. Therefore, this variation of the preferred embodiment as to the point of introduction of the feed to the absorption zone can be desirable when the configuration of the upstream fluid catalytic cracking unit is such that liquid and vapor portions of the feed are delivered to the separation process in separate conduits and when the liquid portion arrives at the separation process unsaturated insoluble vaporous feed components.

Any type of absorption apparatus capable of providing adequate countercurrent contacting of the feed stream with a descending stream of absorption liquid may be utilized. Preferably, the absorption zone is one or more vertically disposed plate or packed absorption towers, having a total of 20 or more contact stages. The absorption zone is maintained at conditions selected to cause the absorption of at least a portion of the vaporous components of the feed which it is desired to recover in the process. In general, the hydrocarbons these conditions include a pressure of from about 100 to 500 psig. or higher and a temperature of from about 60° to 150° F. A preferred temperature range for the effluent streams from the absorption zone is 80° to 140° F. Since absorption is normally exothermic, it may be necessary to provide one or more heat removal means to prevent the temperature within the absorption zone from exceeding these limits. The heat removal means can be a system, such as those well known in the art, which removes liquid from an otherwise overheated stage within the absorption zone, pumps this liquid through a cooling device and returns the cooled liquid to the stage immediately below. The heat removal means may also be indirect heat exchangers located within the absorption zone. It is within the expertise of those skilled in the art to select effective absorption conditions when inorganic chemicals are being recovered from the feed stream.

Liquid flowing downward within the absorption zone, countercurrent to upward-flowing vapors, is provided by two streams of different lean absorber liquid which enter the upper portion of the absorption zone 2 in conduits 8 and 9. These streams are referred to as being lean because they are substantially less than saturated with the vaporous feed components which it is desired to remove from the feed stream. In flowing downwardly through the absorption zone, the lean absorber liquids absorb vaporous hydrocarbon feed components and a portion of the gaseous feed components. The combined lean absorber liquids, absorbed vaporous feed components and liquid feed components exit the absorption zone 2 as a mixture referred to as the rich absorber liquid. Gases which have not been absorbed by the absorber liquid are withdrawn from the top of the absorption zone and preferably are substantially free of the feed components which it is desired to recover. As used herein the term "substantially free" is intended to indicate that at least 80 mole percent, and preferably 90 mole percent of the material chosen for recovery which enters in the feed stream is no longer present in the gaseous stream vented from the top of the absorption zone. The rich absorber liquid withdrawn from the absorption zone is then introduced into an upper portion of the stripping zone.

As was indicated above, in the preferred embodiment it is desired that hydrogen, methane and ethane exit the separation process as gases in conduit 3 and that propane, propylene, butanes and butylenes exit the process as a vapor product in conduit 14. Ideally, therefore, the rich absorber liquid leaving absorption zone 2 in conduit 4 would contain no hydrogen or methane. However, a portion of the hydrogen, methane and ethane in the feed is unavoidably absorbed in the rich absorber liquid. The primary function of the stripping zone is to remove these unwanted absorbed gases. In general, the function of the stripping zone is to effect the separation of those materials having a lower boiling point than it is desired to recover from the rich absorber liquid. Stripping zone 5 may be a conventional, multistage, vertically disposed plate or packed tower provided with heat input means to furnish the vapors for stripping. This heat input means may be a conventional kettle reboiler, stabbed-in reboiler or other such device.

The stripping tower should preferably have 20 or more contact stages. Rich absorber liquid preferably enters the stripping tower near the top in order that rich absorber liquid provides liquid for rectification in all contact stages. Vapor generated through boiling of liquid in the heat input means flows upwardly in the stripping zone and countercurrently contacts the rich absorber liquid. The rectification which ensues enriches the vapor phase within the stripping zone in the lighter components, such that the vapor phase withdrawn from the stripping zone, referred to as the stripping zone overhead product or overhead vapor, contains substantially all of the hydrogen and methane which entered stripping zone 5 with the rich absorber liquid. This is intended to indicate the removal of at least 90 percent and preferably 95 mole percent of these lighter materials. Because the stripped vapor also contains some heavier materials including propane it is returned in conduit 6 to conduit 1 and enters the absorption zone with the feed. In this manner the heavier materials which have unavoidably been stripped from the rich absorber liquid may be recovered, and the gaseous material in the stripping zone overhead may leave the absorption zone in conduit 3.

It should be noted that this configuration, whereby the stripping zone overhead vapor is commingled with the feed before introduction of the feed into the absorption zone, is only one embodiment of the invention. Another embodiment is to introduce the stripping zone overhead vapor at a point above the feed inlet. In a third embodiment, when the stripping zone overhead vapor has been cooled and partially condensed before arrival at the absorption zone, the resulting vapor-condensate mixture is fed into the absorption zone at the point at which the ratio of material to be rejected to material to be recovered within the absorption zone most closely approximates the corresponding ratio of the stripped vapor-condensate mixture. A particularly convenient point for entry of the vapor-condensate mixture is the point of return of cooled material from the aforementioned heat removal means to the absorption zone.

The rich absorber liquid, after being stripped of absorbed gases in the stripping zone, is referred to as a stripped liquid and exits stripping zone in conduit 7. This stripped liquid is divided into two portions having equal compositions. One portion of the stripped liquid exits conduit 7 in conduit 10 and passes to fractionation zone 11. The remaining fraction of stripped liquid exits conduit 7 in conduit 8 and passes as the primary lean absorber liquid to absorption zone 2. Since the stripped liquid still contains the materials chosen for recovery, in this case $C_3$ and $C_4$ hydrocarbons, the primary lean absorber liquid therefore contains the material chosen for recovery. The stripped liquid also contains the material forming the bottoms product of the fractionation zone.

Stripped liquid entering fractionation zone 11 in conduit 10 is fractionated into an overhead product comprising the $C_3$ and $C_4$ hydrocarbons which it is desired to recover from the feed stream and a bottoms liquid material containing all the heavier hydrocarbons. The bottoms liquid material, which is suitable for use as lean absorber liquid, exits fractionation zone 11 in conduit 12. A portion of bottoms liquid material exits conduit 12 in conduit 9 and passes to absorption zone 2 as the secondary lean absorber liquid. The portion of bottoms material remaining in conduit 12 exits in conduit 13, leaving the process as a stabilized hydrocarbon liquid product. This product principally comprises hydrocarbons having 5 or more carbon atoms. Its flow rate is set to remove from the process the $C_5$-plus material recovered from the feed stream. A larger amount may be removed as a slipstream used to maintain the purity of the secondary lean liquid. For instance if it is desired to use a liquid predominating in $C_9$ aromatics, the slipstream would be stripped to remove $C_5$-$C_8$ hydrocarbons and the stripped liquid returned to the process. In the preferred embodiment the secondary lean liquid comprises a gasoline having a boiling point range of about 100° F. to about 400° F. or higher.

Fractionation zone 11 may be any type of conventional, multistage, vertically oriented, plate or packed fractionation tower having 25 or more contact stages, and is furnished with overhead vapor condensing means and a reboiler heat input means. The fractionation zone feed preferably enters at or near the middle of the fractionation tower. The fractionation zone also has means for returning a portion of the overhead liquid material (condensed overhead vapor) to the fractionation tower as reflux. The remaining portion of overhead vapor material exits the fractionation zone in conduit 14 as a vapor product, in this case as hydrocarbon vapor suitable for the production of LPG. The hydrocarbon vapor product comprises hydrocarbons having 3 or 4 carbon atoms per molecule. It is very much within the expertise of those skilled in the art to choose proper operating conditions for use in the stripping zone and in the fractionation zone as these are conventional operations.

The stripped liquid, while suitable for use as lean absorber liquid, is not as effective as is the fractionation zone bottoms material for absorption of the lightest feed components. This is because it already contains some of the material to be recovered. The recovery of vaporous feed components is however maximized by the preset geometry of the upper section of the absorption zone. It is necessary that the fractionation zone bottoms used as the secondary lean absorber liquid enter the absorption zone above the top contact stage. This absorber liquid is devoid of the material to be recovered and therefore absorbs that portion allowed to pass upward by the primary absorber lean absorber liquid. It is also necessary that the stripped liquid used as the primary lean absorber liquid enter the absorption zone below the entry of secondary lean absorber liquid. In the preferred embodiment of my invention the two entry points of the lean absorber liquids should be separated by 5 to 10 of the absorption zone contact stages.

My invention has the advantage of requiring less energy than prior art recovery processes. By utilizing stripped liquid as a portion of the total lean absorber liquid the quantity of fractionation zone bottoms used as lean absorber liquid is reduced. Reduction of the recycle of fractionation zone bottoms to the absorption zone reduces the loading of the fractionation zone, and, hence, the energy consumption of the fractionation zone is reduced.

The preferred embodiment of the invention may be characterized as a process for the separation of $C_3$ and $C_4$ hydrocarbons from a gaseous stream which comprises the steps of introducing a feed stream comprising $C_1$-$C_4$ hydrocarbons into a lower portion of an absorption zone while simultaneously introducing a first lean absorber liquid comprising $C_7$ hydrocarbons and a second lean absorber liquid comprising $C_3$ and $C_7$ hydrocarbons into an upper portion of said zone, the first absorber liquid being introduced at a higher elevation than the second absorber liquid; countercurrently contacting the feed stream with the absorber liquids in the absorption zone at conditions effective to absorb $C_3$ and $C_4$ hydrocarbons in the absorber liquids; withdrawing a rich absorber liquid comprising $C_2$, $C_3$, $C_4$ and $C_7$ hydrocarbons from the lower portion of the absorption zone and withdrawing from the upper portion of the absorption zone a gas stream substantially free of $C_3$-$C_4$ hydrocarbons; passing the rich absorber liquid into an upper portion of a stripping column operated at stripping conditions effective to remove $C_2$ hydrocarbons from the rich absorber liquid and thereby effecting the formation of a stripped liquid comprising $C_3$, $C_4$ and $C_7$ hydrocarbons and a stripping column overhead stream comprising $C_2$ and $C_3$ hydrocarbons; passing the stripping column overhead stream into the lower portion of the absorption zone in admixture with the feed stream; dividing the stripped liquid into a first portion and a second portion of like composition; introducing the first portion of the stripped liquid into the upper portion of the absorption zone as the second lean absorber liquid; fractionating the second portion of the stripped liquid at conditions effective to provide a bottoms stream comprising a $C_7$ hydrocarbon and an overhead product comprising $C_3$ and $C_4$ hydrocarbons; and, supplying a portion of the bottoms stream to the upper portion of the absorption zone as the first lean absorber liquid.

The recovery process of my invention is fully as useful for the recovery and separation of inorganic vapors and liquids as for organic vapors and liquids. It should be noted, also, that where the feed contains no liquid, a suitable absorber liquid can be introduced into the system and held therein by not withdrawing a liquid product. In such cases the absorber liquid may be introduced in a quantity sufficient to establish a working inventory within the recovery process prior to introduction of feed. Periodic addition of fresh absorber liquid may be required to compensate for losses due to leakage of absorber liquid from the system or due to degradation of the absorber liquid.

Reasonable variation and modification are possible within the scope of the foregoing disclosure, the drawing and the claims to the invention without departing from the spirit thereof. As one example, the stripping zone may be operated to reject $C_3$ hydrocarbons overhead, and fractionation zone may be operated to produce an overhead product consisting of essentially pure $C_4$ hydrocarbons. Alternatively, the fractionation zone overhead may comprise $C_4$ and $C_5$ hydrocarbons.

I claim as my invention:

1. A process for the separation of $C_3$ and $C_4$ hydrocarbons from a gaseous stream which comprises the steps of:

a. introducing a feed stream comprising $C_1$-$C_4$ hydrocarbons into a lower portion of an absorption zone while simultaneously introducing a first lean absorber liquid comprising $C_7$ hydrocarbons and a second lean absorber liquid comprising $C_3$ and $C_7$ hydrocarbons into an upper portion of said zone, the first absorber liquid being introduced at a higher elevation than the second absorber liquid;

b. countercurrently contacting the feed stream with the absorber liquids in the absorption zone at conditions effective to absorb $C_3$ and $C_4$ hydrocarbons in the absorber liquids;

c. withdrawing a rich absorber liquid comprising $C_2$, $C_3$, $C_4$ and $C_7$ hydrocarbons from the lower portion of the absorption zone and withdrawing from the upper portion of the absorption zone a gas stream substantially free of $C_3$ - $C_4$ hydrocarbons;

d. passing the rich absorber liquid into an upper portion of a stripping column operated at stripping conditions effective to remove $C_2$ hydrocarbons from the rich absorber liquid and thereby effecting the formation of a stripped liquid comprising substantially all of the $C_3$, $C_4$ and $C_7$ hydrocarbons contained in the rich absorber liquid and a stripping column overhead vapor stream comprising $C_2$ hydrocarbons but substantially free of $C_4$ hydrocarbons;

e. passing the stripping column overhead stream into the lower portion of the absorption zone;

f. dividing the stripped liquid into a first portion and a second portion of like composition;

g. introducing the first portion of the stripped liquid into the upper portion of the absorption zone as the second lean absorber liquid;

h. fractionating the second portion of the stripped liquid at conditions effective to provide a bottoms stream comprising a $C_7$ hydrocarbon and an overhead product comprising $C_3$ and $C_4$ hydrocarbons; and, i. supplying a portion of the bottoms stream to the upper portion of the absorption zone as the first lean absorber liquid.

2. The process of claim 1 further characterized in that the stripping column overhead stream is admixed with the feed stream prior to passage into the absorption zone.

3. The process of claim 1 further characterized in that the first absorber liquid and the bottoms stream comprises a naphtha, and in that the second absorber liquid comprises a naphtha and $C_3$ hydrocarbons.

4. The process of claim 1 further characterized in that a second portion of the bottoms stream from step (h) is removed as a product stream.

5. A process for the recovery of a $C_2$ hydrocarbon from a gaseous stream which comprises the steps of:

a. introducing a feed stream comprising $C_1$ and $C_2$ hydrocarbons into a lower portion of an absorption zone while simultaneously introducing a first lean absorber liquid comprising a hydrocarbon having from three to eight carbon atoms per molecule and a second lean absorber liquid comprising a $C_2$ hydrocarbon and the hydrocarbon having from three to eight carbon atoms per molecule contained in the first absorber liquid into an upper portion of said zone, the first liquid being introduced at a higher elevation than the second liquid;

b. countercurrently contacting the feed stream with the absorber liquids in the absorption zone at conditions effective to absorb $C_2$ hydrocarbons in the absorber liquids;

c. withdrawing a rich absorber liquid comprising methane and $C_2$ hydrocarbons and the hydrocarbon having from three to eight carbon atoms per molecule from the lower portion of the absorption zone and withdrawing from the upper portion of the absorption zone a gas stream having a lower concentration of $C_2$ hydrocarbons than the feed stream;

d. passing the rich absorber liquid into an upper portion of a stripping column operated at stripping conditions effective to remove methane from the rich absorber liquid and thereby effecting the formation of a stripped liquid comprising a $C_2$ hydrocarbon and substantially all of the hydrocarbon having from three to eight carbon atoms per molecule contained in the rich absorber liquid and a stripping column overhead vapor stream comprising methane and $C_2$ hydrocarbons but substantially free of $C_3$ and heavier hydrocarbons;

e. passing the stripping column overhead stream into the lower portion of the absorption zone;

f. dividing the stripping liquid into a first portion and a second portion of like composition;

g. introducing the first portion of the stripped liquid into the upper portion of the absorption zone as the second lean absorber liquid;

h. fractionating the second portion of the stripped liquid at conditions effective to provide a bottoms stream comprising the hydrocarbon having from three to eight carbon atoms per molecule and an overhead product comprising a $C_2$ hydrocarbon; and, i. supplying a portion of the bottoms stream to the upper portion of the absorption zone as the first lean absorber liquid.

* * * * *